US007727089B2

(12) United States Patent
Gilman

(10) Patent No.: US 7,727,089 B2
(45) Date of Patent: Jun. 1, 2010

(54) ATHLETIC TRAINING SLED APPARATUS

(75) Inventor: Neil F. Gilman, Glastonbury, CT (US)

(73) Assignee: Marty Gilman, Inc., Gilman, CT (US)

( * ) Notice: Subject to any disclaimer, the term of this patent is extended or adjusted under 35 U.S.C. 154(b) by 31 days.

(21) Appl. No.: 11/764,046

(22) Filed: Jun. 15, 2007

(65) Prior Publication Data

US 2008/0312009 A1 Dec. 18, 2008

(51) Int. Cl.
*A63B 69/34* (2006.01)

(52) U.S. Cl. ..... 473/445; 473/441; D21/788

(58) Field of Classification Search ..... 473/422, 473/445, 441, 440, 438; 434/253; 482/90, 482/93–95; D21/534, 788, 791, 767
See application file for complete search history.

(56) References Cited

U.S. PATENT DOCUMENTS 3,355,186 A * 11/1967 Bradley ..... 280/19
3,380,084 A * 4/1968 Savage ..... 248/317
4,453,742 A * 6/1984 Zepkowski ..... 280/818
4,890,495 A * 1/1990 Slane ..... 482/51
5,385,523 A * 1/1995 Forrest ..... 473/445
5,397,154 A * 3/1995 Baldwin ..... 482/71
D377,507 S * 1/1997 Thomas, Sr. ..... D21/534
D390,500 S * 2/1998 Walker ..... D12/9
D466,963 S * 12/2002 Forrest ..... D21/788
D469,142 S * 1/2003 Forrest ..... D21/788
D478,954 S * 8/2003 Forrest ..... D21/788
6,612,971 B1 * 9/2003 Morris ..... 482/74
6,685,581 B2 * 2/2004 Krause et al. ..... 473/445
6,942,585 B1 * 9/2005 Krause ..... 473/445
7,322,893 B2 * 1/2008 Bright ..... 473/441
D562,417 S * 2/2008 Noojin ..... D21/698

OTHER PUBLICATIONS

"The Sprinter's Sled", Speed City International, Inc., Fall 2002 Catalog, p. 10.
"Power Sled", Power Systems Sports, 2007 Catalog, p. 15.
"Handle for Power Sled", Power Systems Sports, 2007 Catalog, p. 15.
"Sled Dawg", MF Athletic Catalog, 2007, p. 33.
"Sled of Champions", Perform Better Catalog, 2006 Sports Edition, p. 4.

* cited by examiner

*Primary Examiner*—Mitra Aryanpour
(74) *Attorney, Agent, or Firm*—Holland & Knight LLP; Mark H. Whittenberger, Esq.

(57) ABSTRACT

A weight sled apparatus useful for strength training and simulating the resistance of an opponent during a blocking event has a tubular construction forming a U-shaped member having a pair of parallel legs which serve as runners. A weight bearing member affixed to and extending between the pair of runners allows mounting of removable mount weights on a horn projecting therefrom. A crossbar extending between the runner ends presents a rearward facing surface at least 8 inches above the plane of the runners against which force may applied. An optional handlebar attachment presents a rearward facing surface against which force may applied in a range from 8 inches to 40 inches above the plane of the runners and normal thereto. The weight sled affords a trainee multiple force application surfaces near the center of gravity of the sled and at differing vertical heights, enabling a more realistic simulation of the resistance presented during a blocking event.

15 Claims, 3 Drawing Sheets

Fig. 1
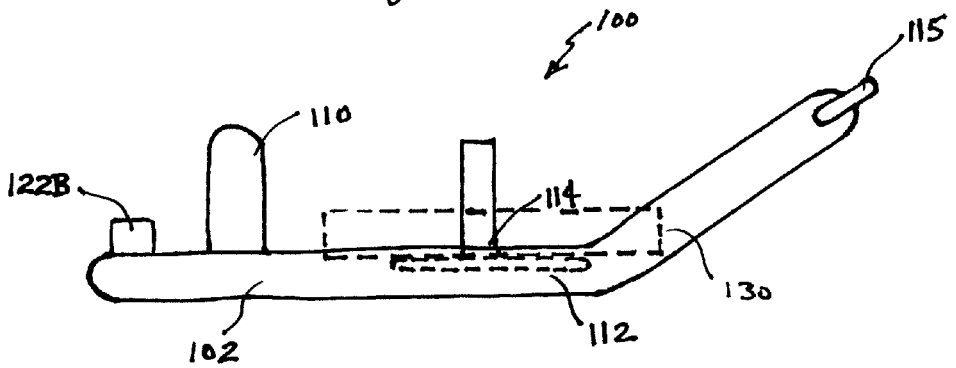
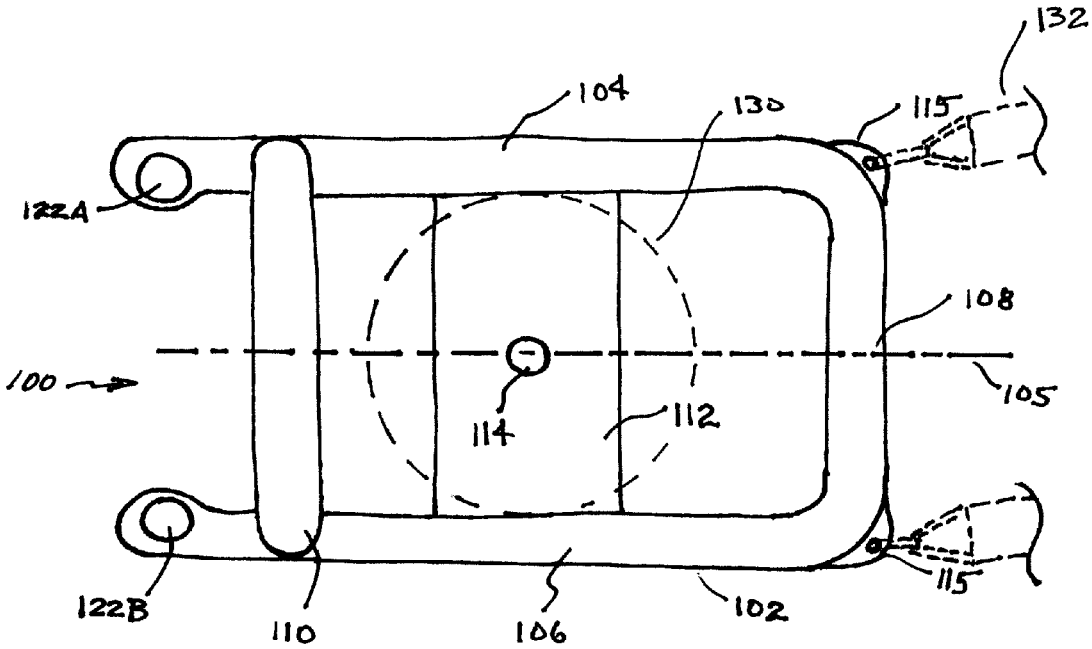
Fig. 2

ATHLETIC TRAINING SLED APPARATUS

FIELD OF THE INVENTION

The invention relates generally to sports-related training equipment and devices, particularly, training devices that simulate an opponent's mass.

BACKGROUND OF THE INVENTION

It is generally accepted that the better prepared a sports team is, the more successful they will be at the game. While many factors affect a team's preparedness, the training equipment available to a team has traditionally been considered critical. Consequently, training equipment has continued to evolve, as players and teams attempt to gain a competitive advantage over opponents. This evolution has resulted in a closer approximation of "game-like" conditions for the athletes during practices. Simulating game-like conditions has allowed the players to finely tune their skills in ways that directly translate into increased "on-field" performance. In sports where the blocking of another player is permitted, such as in football, the training of an athlete in how to physically block an opponent is highly desirable.

Football has traditionally relied on a variety of training equipment for simulating game-like conditions. In football, it is a common belief that to control a football game, a team must control the line of scrimmage. In accordance with this premise, if the team on offense controls the line of scrimmage, i.e., effectively blocks, its quarterback is given ample time to throw the football to a receiver or, alternatively, a running-back is given ample room to maneuver and gain yardage before being tackled by opponents. On defense, controlling the line of scrimmage results in pressure being applied to the quarterback or a running-back before significant yardage, if any at all, can be gained by the offense.

To develop strength and simulate game-like blocking conditions, a number of weight sleds are commercially available. Examples of such devices include the Sled Dog product, commercially available from MF Athletic Company, Cranston R.I.; the Sprinter's Sled commercially available from SpeedCity, Jackson Miss.; and the Speed Sled, Power Sled and Handle Power Sled, commercially available Power Systems, Knoxville, Tenn. These devices typically include a pair of separate runners attached to a frame or platform that is capable of supporting weight. The device is then weighted and either pulled or pushed to develop strength in handling the resistance presented by the weighted sled. In a blocking simulation exercises the sled is manually pushed to simulate the weight of an opponent. It is common for an opponent, initially in a crouched position, to rise up vertically from the crouch position while simultaneously providing forward momentum which must be resisted. Accordingly, in order to realistically simulate the weight of an opponent at the line of scrimmage, the surface against which the trainee's force is applied should be neither too low or too high relative to the ground, otherwise the combined weight of the sled and the resistance between the sled and the ground will not accurately simulate an opponent's resistance to the trainee's thrust. Some manufacturers have attempted to attach a removable handle that extends obliquely from the sled. Unfortunately, the length of the handle causes the force application surface to be displaced too far from the center of gravity of the sled, thereby resulting in a simulation of an opponent's resistance that is more like pushing a heavy lawn mower rather than throwing a block. In addition, over exertion of force by a trainee to an under weighted sled having separate runners may result in one or both runner ends digging into the ground and either presenting unrealistic resistance as well as possibly tipping the sled. As such, many of the weight sled products commercially available do not accurately mimic the momentum and resistance presented by an opposing player during the process of throwing a block.

Accordingly, a need exists for a training device that provides a trainee with a blocking target having a resistance application surface at the proper vertical height relative to the ground.

Another need exists for a training device that provides a trainee with a blocking target having a resistance application surface that may be applied at multiple continuous vertical heights relative to the ground.

Yet another need exists for a training device that provides a trainee with a blocking target having a resistance application surface that is close to the center of gravity of the weight carried by the device regardless of the vertical height, relative to the ground, at which the trainee applies force.

Still a further need exists for a training device that does not have exposed runner ends.

SUMMARY OF THE INVENTION

A weight sled useful for strength training and simulating the resistance of an opponent during a blocking event comprises a pair of nonlinear runners of tubular construction arranged in parallel relative to a hypothetical center axis. A first, weight bearing member extends between the two runners at near the mid-sections thereof. A second member also of tubular construction extends between first ends of the runners and is joined thereto so as to form a continuous U-shaped member with the two runners. A third member also of tubular construction extends between second ends of the runners and is joined thereto. The third member is displaced a distance above the plane of the weight bearing member and provides a force application surface not near the ground and at the opposite end of the sled opposite that where the runners are joined in a contiguous manner. An optional extension member may be removably secured to either the third member or near the second ends of the runners so as to provide additional force application surfaces not near the ground and at the end of the sled opposite that where the runners are joined. In this manner, the weight sled disclosed herein affords a trainee multiple force application surface near the center of gravity of the sled and at differing vertical heights enabling a more realistic simulation of the resistance presented during a blocking event. In addition, the runners of the weighted sled disclosed will not dig into the ground even during over exertion of force by a trainee to an under weighted sled.

According to one aspect of the invention, a weight sled apparatus useful for strength training and simulating the resistance of an opponent during a blocking event comprises: (A) a pair of nonlinear runners of tubular construction arranged in parallel relative to a center axis and a plane; (B) weight bearing member affixed to and extending between the pair of nonlinear runners near mid-sections thereof; (C) a first crossbar of tubular construction extending between first ends of the runners and joined thereto so as to form a continuous tubular U-shaped member with the runners; (D) a second crossbar of tubular construction extending between said runners proximate second ends thereof and joined thereto so as to present a rearward facing surface against which force may applied; and (E) an attachment mechanism shaped to receive in a complementary mating manner a handle bar device. In one embodiment, a handle bar of tubular construction is joinable in a complementary mating manner to the attachment mechanism of the weight sled apparatus. The handlebar present a rearward facing surface against which force may applied in a range from 8 inches to 40 inches above the plane of the runners. In another embodiment, the attachment mechanism comprises a pair of posts sized to be received within the tubular ends of the handlebar, the pair of posts are disposed proximate the second ends of the runners or all in the second crossbar.

According to a second aspect of the invention, weight sled apparatus useful for strength training and simulating the resistance of an opponent during a blocking event comprises: (A) a continuous tubular U-shaped member having a pair of legs which serve as runners, said legs arranged in parallel relative to a center axis and a plane; (B) a weight bearing member affixed to and extending between the pair of nonlinear runners near mid-sections thereof and adapted to removable mount weights; and (C) a crossbar of tubular construction extending between said runners proximate ends thereof and joined thereto so as to present a rearward facing surface disposed at least 12 inches above the plane of the runners against which force may applied.

According to a third aspect of the invention, a weight sled apparatus useful for strength training and simulating the resistance of an opponent during a blocking event comprises: (A) a continuous tubular U-shaped member having a pair of legs which serve as runners, said legs arranged in parallel relative to a center axis and a plane; (B) a weight bearing member affixed to and extending between the pair of nonlinear runners near mid-sections thereof and adapted to removable mount weights; and (C) a handlebar of tubular construction extending between said runners proximate ends thereof and joined thereto so as to present a rearward facing surface against which force may applied in a range from 8 inches to 40 inches above the plane of the runners and normal thereto.

BRIEF DESCRIPTION OF THE DRAWINGS

The above and further advantages of the invention may be better understood by referring to the following description in conjunction with the accompanying drawings in which:

FIG. 1 illustrates a side view of one embodiment of a weight sled in accordance with the principles of the present disclosure;

FIG. 2 illustrates a top view of one embodiment of a weight sled in accordance with the principles of the present disclosure;

DETAILED DESCRIPTION

Figure 4:
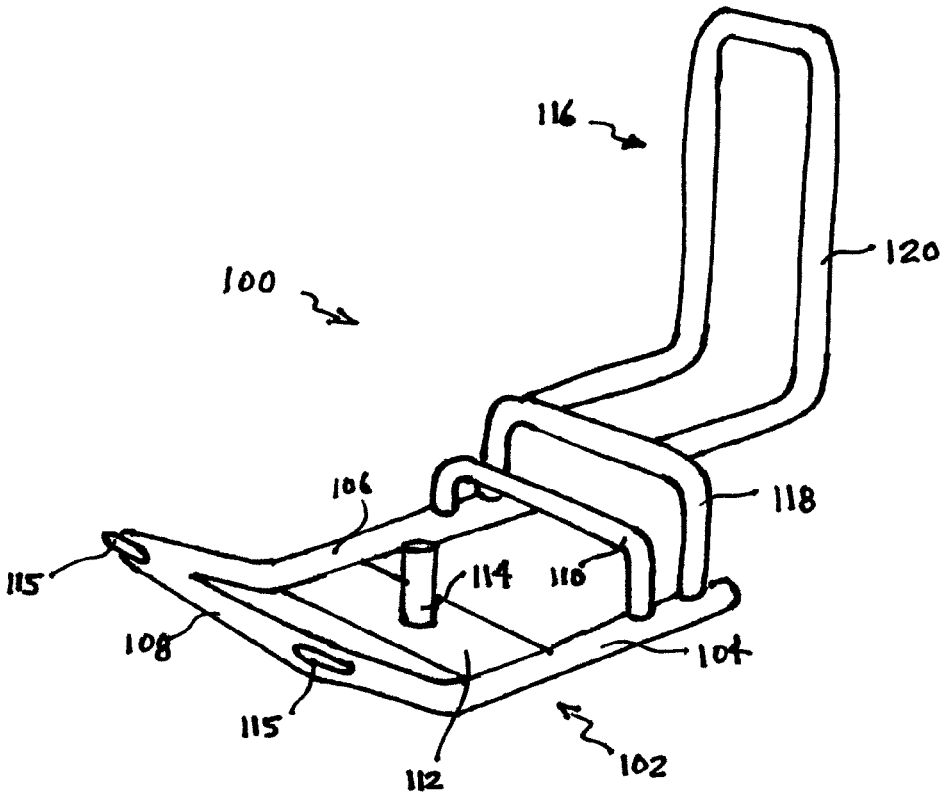
FIG. 4 illustrates a perspective elevation view of one embodiment of a weight sled shown a removable handlebar attached thereto in accordance with the principles of the present disclosure.

The weight sled apparatus according to various illustrated embodiments disclosed herein enables a trainee to develop power at the height of the player coming out of his stance. The elevated handlebars allow a trainee to drive the sled in a posture that realistically simulates game conditions, thereby helping the trainee to develop strength and power in the knees, ankles and hips. The sled can be driven from either the lower tandem bar at the bear crawl level or from a higher level of a two-point stance and takeoffs. A weight sled embodying various aspects of the sled apparatus 100 described herein is the King Crab Sled, commercially available from Marty Gilman, Inc., Gilman, Conn.

The inventive weight sled apparatus, including an illustrative embodiment and various alternative embodiments are described hereinafter in greater detail with reference to the FIGS. 1-4 (not shown to scale). A sled apparatus 100 according to one illustrative embodiment comprises a U-shaped chassis 102, a rear crossbar 110, a weight crossbar 112, a weight horn 114, and a mechanism for mounting a removable handlebar 116, as explained hereinafter in greater detail.

Figure 3:
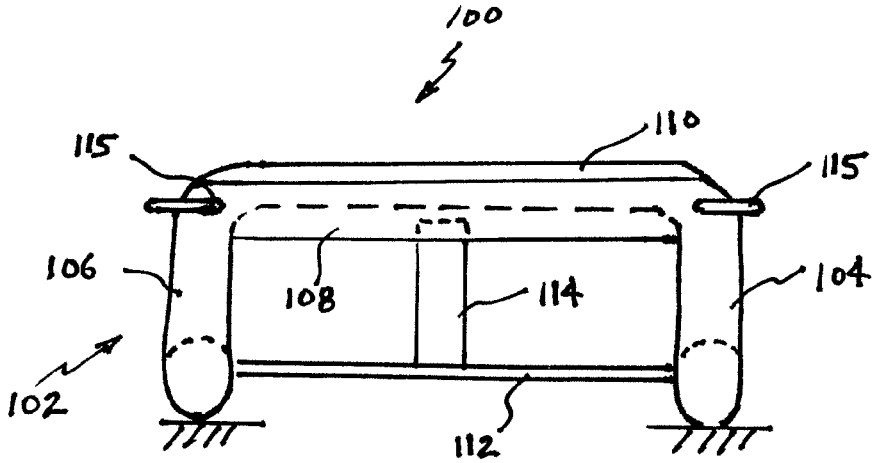
FIG. 3 illustrates a front view of one embodiment of a weight sled in accordance with the principles of the present disclosure.
Figure 5:
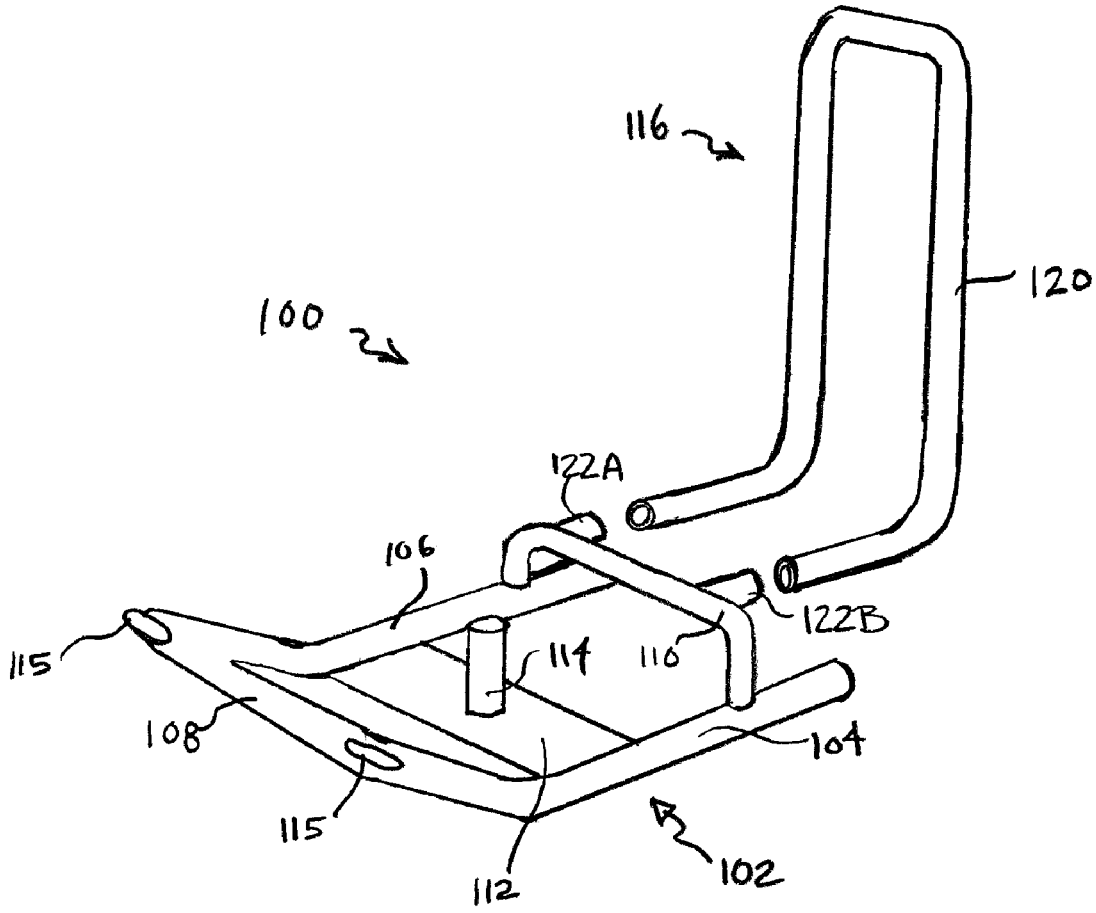
FIG. 5 illustrates a perspective elevation view of another embodiment of the weight sled.

The U-shaped chassis 102 further comprises runners 104 and 106 and head crossbar 108. Each of runners 104 and 106 and head crossbar 108 are formed of rigid material, such as 2" aluminum pipe having a 0.25 wall thickness, and a have a substantially tubular construction. As illustrated, each of runners 104 and 106 have a substantially straight section and a section that is bent at an upward angle relative to the straight section. As a result, from a plan or side view, runners 104 and 106 appear to have a nonlinear profile. As illustrated in FIG. 2, runners 104 and 106 are arranged parallel to each other and to a hypothetical center axis 105. In FIG. 2, runners 104 and 106 rest on a plane at least partially coextensive with the plane of the paper or image, such plane also illustrated in FIG. 3. Head crossbar 108 is substantially straight and joins runners 104 and 106 at their respective upward bent ends. In one embodiment, U-shaped chassis 102 may comprise individual tubular pieces mechanically joined by welding or any number of techniques known in the arts, or, alternatively, may be formed from a single piece of tubing, so that chassis 102 as a unitary body. In FIG. 3, portions of runners 104 and 106, rear crossbar 110 and weight horn 114 are shown in phantom.

Weight crossbar 112 may be implemented with a substantially flat rectangular plate also formed of a rigid material such as aluminum or steel and extends between runners 104 and 106 approximately adjacent the respective bent sections thereof, as illustrated. Weight crossbar 112 may be mechanically joined by welding or other techniques known in the arts to chassis 102 so as to form a unitary body therewith. The substantially flat surface presented by crossbar 112 provides an area on which to removably mount weights. Weight crossbar 112 is shown in phantom in FIG. 1. Weight horn 114 having a generally cylindrical shape and also made of substantially rigid material is secured to the weight bearing surface of crossbar 112 at a right angle thereto. In the illustrative embodiment, weight horn 114 may be implemented with aluminum tubing similar to runners 104 and 106. The diameter of weight horn 114 may be chosen to accommodate the hole in standard weight sets, and may be chosen to have a length which enables vertical stacking of several plates of weights onto crossbar 112.

Rear crossbar 110 extends between runners 104 and 106 proximate the respective straight sections thereof and may be implemented with aluminum tubing similar to runners 104 and 106. Rear crossbar 110 may also be mechanically joined by welding or other techniques to chassis 102 so as to form a unitary body therewith. Rear crossbar 110 presents a rearward facing surface against which a trainee may apply force during a training exercise. The height of rear crossbar 110 relative to the ground or other surface on which sled 100 rests is chosen to allow the sled to be driven at the bear crawl level, approximately 8 to 12 inches off the ground.

A pair of front attachment mechanisms 115, implemented with eyelets welded to chassis 102 in the illustrative embodiments, are disposed at the corners of chassis 102 to facilitate attachment of straps, ropes, cords, chains, etc., to allow the trainee to also drag the sled 100 as well as push the same.

As illustrated in FIG. 4, an optional removable handlebar 116 comprises a generally U-shaped attachment crossbar 118 and a generally U-shaped grip bar 120 joined together to form a unitary body that may be selectively attachable/detachable to/from chassis 102. The upper leg extremities of U-shaped grip bar 120 are parallel and spaced more narrowly, e.g. 13 inches, than the distance between runners 104 and 106. Grip bar 120 presents a range of vertical heights at which a trainee may grab the bars with a thumbs-up grip. As illustrated in FIG. 4, the lower leg extremities of grip bar 120 are bent at a right angle so that bar 120 has a substantially L-shaped profile from the side. The leg end of grip bar 120 are mechanically joined by welding or other techniques to attachment crossbar 118 so as to form a unitary body therewith. Attachment crossbar 118, in turn, is removably mounted to chassis 102 near the ends of runners 104 and 106, rearward of rear crossbar 110. The L-shaped side profile of grip bar 120 enables the force applied to grip bar 120 to be transferred to chassis 102 at a point which is more proximate the center of gravity of the sled 100. The U-shaped grip bar 120 and attachment crossbar 118 may be of similar design and construction to rear crossbar 110 and chassis 102, but with modified shapes. A pair of posts 122A-B are affixed to and project upwardly from the rear ends of runners 104 and 106, respectively, and are shaped and sized to receive the open hollow ends of the legs of attachment crossbar 118 in a complementary mating matter. Handlebar 116, therefore, may be to manually and rapidly attached or moved from chassis 102, without the need for tools.

Handlebar 116 presents a rearward facing surface against which a trainee may apply force during a training exercise. The height of handlebar 116 relative to the ground or other surface on which sled 100 rests is chosen to allow the sled to be driven from a range of levels from a lower bear crawl to a higher two-point stance and takeoffs. In one embodiment, handlebar 116 may have a height of approximately 20 to 40 inches from the plane on which runners 104 and 106. As such, handlebar 116 allows a trainee to drive the sled in a range of postures that realistically simulate the height of an opponent player coming out of a stance.

In an alternative embodiment all component parts of weight sled 100, including handlebar 116, may also be mechanically joined by welding or other techniques to form a completely unitary bodied apparatus. In such alternative embodiment, the rear crossbar 110 may be eliminated.

In another alternative embodiment, grip bar 120 may be vertically lengthened and have its legs attached directly to rear crossbar 110. In such alternative embodiment, posts 122 are affixed to and project either upwardly or rearwardly from attachment crossbar 118 and are shaped and sized to receive the open hollow ends of the legs of grip bar 120 in a complementary mating matter.

In another alternative embodiment, attachment crossbar 118 of handlebar 116 may be attached directly to chassis 102 proximate posts 122A-B or rear crossbar 110. In such embodiment, either or of both posts 122A-B and rear crossbar 110 may be eliminated.

In yet another alternative embodiment, chassis 102 may have attached thereto various hooks or handles that allow for the temporary attachment of straps, ropes or other devices so that the weight sled 100 may be pulled by a trainee during various strength conditioning exercises.

In yet another alternative embodiment, all or portion of the weight sled 100 may be painted or powder coated for protection against the elements.

In still other alternative embodiments, any of the embodiments of the weight sled 100 described herein may be sold with or without handlebar 116 and/or with or without weights 130, or an any of removably attachable device 132, such as harnesses, straps or ropes, etc., shown in phantom in FIGS. 1-2.

It will be obvious to those reasonably skilled in the arts that the weight sled described herein, do, in part, to the configuration of the force application surfaces over and their location relative to the sled chassis, affords a trainee multiple force application surfaces near the center of gravity of the sled and at differing vertical heights, As a result, the disclosed weights sleds more realistically simulate an opponent's resistance presented to the trainee's thrust during a blocking event.

Having described herein illustrative embodiments of the present invention, persons of ordinary skill in the art will appreciate various other features and advantages of the invention apart from those specifically described above. It should therefore be understood that the foregoing is only illustrative of the principles of the invention, and that various modifications and additions can be made by those skilled in the art without departing from the spirit and scope of the invention. Accordingly, the appended claims shall not by the particular features which have been shown and described, but shall be construed also to cover any obvious modifications and equivalents thereof

What is claimed is:

1. A weight sled apparatus useful for strength training and simulating the resistance of an opponent during a blocking event comprises:

(A) a pair of nonlinear runners of tubular construction arranged in parallel relative to a center axis and a plane;

(B) weight bearing member affixed to and extending between the pair of nonlinear runners near mid-sections thereof (C) a head crossbar of tubular construction extending between first ends of the runners and joined thereto so as to form a continuous tubular U-shaped member with the runners;

(D) a rear crossbar of tubular construction extending between and disposed above the plane of said runners proximate second ends thereof and joined thereto and opposite the head crossbar so as to present a rearward facing surface against which force may be applied and configured to enable a user to drive the weight sled forward while approximating a bear crawl;

(E) an attachment mechanism shaped to removably receive in a complementary mating manner a handle bar device proximate to the second end of the runners; and wherein the attachment mechanism comprises a pair of posts sized to be received within at least one tubular end of the handlebar device; and wherein the pair of posts are disposed on the rear crossbar.

2. The apparatus of claim 1, wherein the handle bar device includes a tubular construction joinable in a complementary mating manner to the attachment mechanism of the weight sled apparatus.

3. The apparatus of claim 2 wherein the handlebar presents a rearward facing surface against which force may be applied in a range from 8 inches to 40 inches above the plane of the runners.

4. The apparatus of claim 1 wherein the pair of posts are disposed proximate the second ends of the runners.

5. The apparatus of claim 1 wherein the rear crossbar is disposed at least 8 inches above the plane of the runners.

6. The apparatus of claim 1 wherein the handle bar comprises a pair of tubular U-shaped members joined at right angles.

7. A weight sled apparatus useful for strength training and simulating the resistance of an opponent during a blocking event comprises:

(A) a continuous tubular U-shaped member having a pair of legs which serve as runners, said legs arranged in parallel relative to a center axis and a plane;

(B) a weight bearing member affixed to and extending between the pair of nonlinear runners near mid-sections thereof and adapted to removably mount weights; and (C) a rear crossbar of tubular construction extending between said runners proximate ends thereof and joined thereto so as to present a rearward facing surface disposed at least 8 inches above the plane of the runners against which force may be applied to drive the sled forward; and a handle bar of tubular construction removably attached to the weight sled in a complementary mating manner proximate to the ends of the runners;

wherein a pair of posts are disposed on the rear crossbar.

8. The apparatus of claim 7 wherein the handlebar presents a rearward facing surface against which force may applied in a range from 8 inches to 40 inches above the plane of the runners and normal thereto.

9. The apparatus of claim 7 further comprising at least one mechanism attached to the U-shaped member for securing one of ropes, cables and straps to the apparatus.

10. The apparatus of claim 7 wherein the weight bearing member has a substantially flat rectangular profile and further comprises a cylindrical horn extending normal thereto on which weights may be removably mounted.

11. The apparatus of claim 7 wherein:

the handle bar is removably coupled to the rear crossbar.

12. A weight sled apparatus useful for strength training and simulating the resistance of an opponent during a blocking event comprises:

(A) a continuous tubular U-shaped member having a pair of legs which serve as runners, said legs arranged in parallel relative to a center axis and a plane;

(B) a weight bearing member affixed to and extending between the pair of nonlinear runners near mid-sections thereof and adapted to removable mount weights; and (C) a handlebar of tubular construction extending between said runners proximate ends thereof and joined thereto so as to present a rearward facing surface against which force may be applied in a range from 8 inches to 40 inches above the plane of the runners and normal thereto to drive the sled forward;

wherein, the handlebar of tubular construction is configured to mate with a pair of post disposed on a U-shaped attachment crossbar.

13. The apparatus of claim 12 further comprising at least one mechanism attached to the U-shaped member for securing one of ropes, cables and straps to the apparatus.

14. The apparatus of claim 12 wherein the weight bearing member has a substantially flat rectangular profile and further comprises a cylindrical horn extending normal thereto on which weights may be removably mounted.

15. A weight sled apparatus useful for strength training and simulating the resistance of an opponent during a blocking event comprises:

(A) a pair of runners arranged parallel relative to a plane and a center axis;

(B) a weight bearing member affixed to and extending between the pair of runners near mid-sections thereof and adapted to removably mount weights; and (C) a tubular U-shaped crossbar having a pair of legs joined at first respective ends thereof and having second respective ends thereof attached normal to and extending between the runners; and (D) a tubular U-shaped member-handle bar having a pair of legs joined at first respective ends thereof and having second respective ends thereof removably coupled to one of the tubular U-shaped cross bar and the runners so that the legs of the tubular U-shaped handle bar present a rearward facing surface against which force may be applied in a range from 8 inches to 40 inches above the plane of the runners and normal thereto.

* * * * *